US010426245B2

(12) United States Patent
Schmidt et al.

(10) Patent No.: US 10,426,245 B2
(45) Date of Patent: Oct. 1, 2019

(54) IN OR RELATING TO DEODORANT BALLS

(71) Applicant: Obrist Closures Switzerland GmbH, Reinach (CH)

(72) Inventors: Patrick Schmidt, Zell-Kaimt (DE); Derek Hindle, Paris (FR); Rainer Goede, Finnentrop (DE); Peter Stoelben, Briedel Mosel (DE)

(73) Assignee: Obrist Closures Switzerland GmbH, Reinach (CH)

( * ) Notice: Subject to any disclaimer, the term of this patent is extended or adjusted under 35 U.S.C. 154(b) by 231 days.

(21) Appl. No.: 15/125,938

(22) PCT Filed: Mar. 14, 2015

(86) PCT No.: PCT/EP2015/055378
§ 371 (c)(1),
(2) Date: Sep. 13, 2016

(87) PCT Pub. No.: WO2015/136114
PCT Pub. Date: Sep. 17, 2015

(65) Prior Publication Data

US 2017/0079403 A1 Mar. 23, 2017

(30) Foreign Application Priority Data

Mar. 14, 2014 (GB) ..... 1404665.0

(51) Int. Cl.
*A45D 34/04* (2006.01)
*B21D 51/08* (2006.01)

(52) U.S. Cl.
CPC ..... *A45D 34/041* (2013.01); *B21D 51/08* (2013.01)

(58) Field of Classification Search
CPC ..... A45D 34/041; A45D 34/04; A45D 40/26; A45D 40/261; B21D 51/08; B21D 51/00; B21D 53/90; B21D 51/18; B21D 53/00; B21C 37/0803; B21C 37/104
See application file for complete search history.

(56) References Cited

U.S. PATENT DOCUMENTS

| | | | | | |
|---|---|---|---|---|---|
| 1,039,674 | A * | 9/1912 | Schatz | B21D 51/08 | 219/104 |
| 2,963,772 | A * | 12/1960 | Niles, Sr. | B21D 51/08 | 29/463 |
| 3,772,750 | A * | 11/1973 | Hauser | B23K 15/04 | 219/121.35 |
| 4,610,071 | A * | 9/1986 | Miller | A63B 37/00 | 156/73.5 |
| 8,317,080 | B2 * | 11/2012 | Kingston | B23K 20/122 | 228/112.1 |

FOREIGN PATENT DOCUMENTS

| | | |
|---|---|---|
| DE | 10211483 A1 | 9/2003 |
| EP | 1190640 A2 | 3/2002 |

OTHER PUBLICATIONS

ISA European Patent Office, International Search Report and Written Opinion Issued in Application No. PCT/EP2015/055378, dated Jun. 29, 2015, WIPO, 9 pages.

* cited by examiner

*Primary Examiner* — David J Walczak
(74) *Attorney, Agent, or Firm* — McCoy Russell LLP

(57) ABSTRACT

A roll-on applicator ball and a method of forming the roll-on applicator ball, the roll-on applicator ball comprising a first half ball part and a second half ball part. A generally annular connecting ring connects the ball halves together.

20 Claims, 9 Drawing Sheets

IN OR RELATING TO DEODORANT BALLS

CROSS REFERENCE TO RELATED APPLICATIONS

The present application is a U.S. National Phase of International Patent Application Serial No. PCT/EP2015/055378, entitled "IMPROVEMENTS IN OR RELATING TO DEODORANT BALLS," filed on Mar. 14, 2015, which claims priority to Great Britain Patent Application No. 1404665.0 filed on Mar. 14, 2014, the entire contents of each of which are hereby incorporated by reference for all purposes.

TECHNICAL FIELD

The present invention relates to deodorant balls and methods of producing deodorant balls. The term "deodorant ball" is intended to mean a ball which may form part of a "roll-on" dispenser i.e. a dispenser of a liquid cosmetic (such as a deodorant) having a revolving ball as an applicator.

According to an aspect of the present invention there is provided a roll-on applicator ball comprising a first half ball part and a second half ball part, and a generally annular connecting ring which connects the ball halves together.

BACKGROUND AND SUMMARY

A further aspect provides a molded deodorant ball comprising a molded upper part, molded lower part and an overmolded ring which connects the parts after they are assembled.

A further aspect provides a ball comprising a first part and a second part, and a connecting part for connecting the first and second parts after they are assembled.

The ball parts may be formed by injection moulding.

The connecting ring may be formed by injection moulding.

The ball may further comprise a support ring.

The support ring may comprise a peripheral annulus, a hub and one or more spokes extending from the hub to the annulus.

The parts may be: different; similar; substantially the same; or exactly the same. In some embodiments the parts are generally hemispherical.

The parts may be formed from polypropylene.

The formed ball may have a diameter generally in the range 1 inch to 1.4 inches. Smaller and bigger dimensions may be possible using the same principles/technology.

In some embodiments the ball is produced conventionally, with single face molds and assembly and an overmolding process.

In some embodiments the ball is fabricatable by injection molding in one mold with a combined vertical and stack turning; and may include in-mold assembly and overmolding.

The present invention also provides a deodorant pack having a ball as described herein.

A further aspect provides a method of forming a ball comprising the steps of:

a. forming a first ball part and a second ball part;
b. assembling the first and second ball parts; and
c. forming a connecting ring on the assembled parts to join them together.

The method may further comprise the steps of forming a support ring and assembling the support ring together with the ball parts at step b).

The first part and/or connecting ring and/or supporting ring may be formed by injection moulding.

Formation of the ball parts, and when present the support ring, their assembly and the addition of the ring may take place in one machine.

The method may further comprise the step of grinding at least part of the surface of the ball.

A further aspect provides a deodorant ball comprising a first ball part, and a second ball part, and a connecting part which connects the ball parts together.

A further aspect provides a method of forming a ball comprising the steps of:

i. forming a first ball part and a second ball part;
ii. assembling the ball parts together; and
iii. securing the ball parts together with a connecting part.

In some embodiments the production of the ball halves, their assembly and the addition of the ring takes place in one tool or injection machine.

A lightweight ball design may be provided.

An improved production technique may be provided.

In one embodiment the ball comprises two different half ball parts (upper/lower) which are injection moulded, and an additional injected ring which connect the parts after they are assembled.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

BRIEF DESCRIPTION OF FIGURES

The present invention will now be more particularly described, by way of example, with reference to the accompanying drawings, in which.

DETAILED DESCRIPTION

Figure 1:
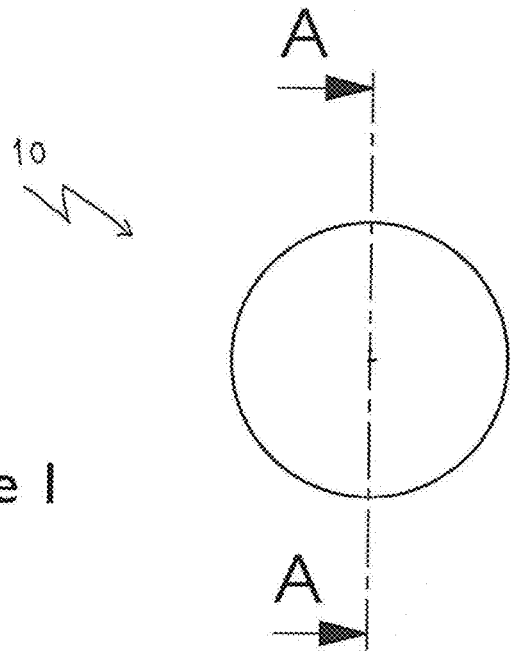
FIG. 1 is a side view of a ball formed in accordance with the present invention.
Figure 2:
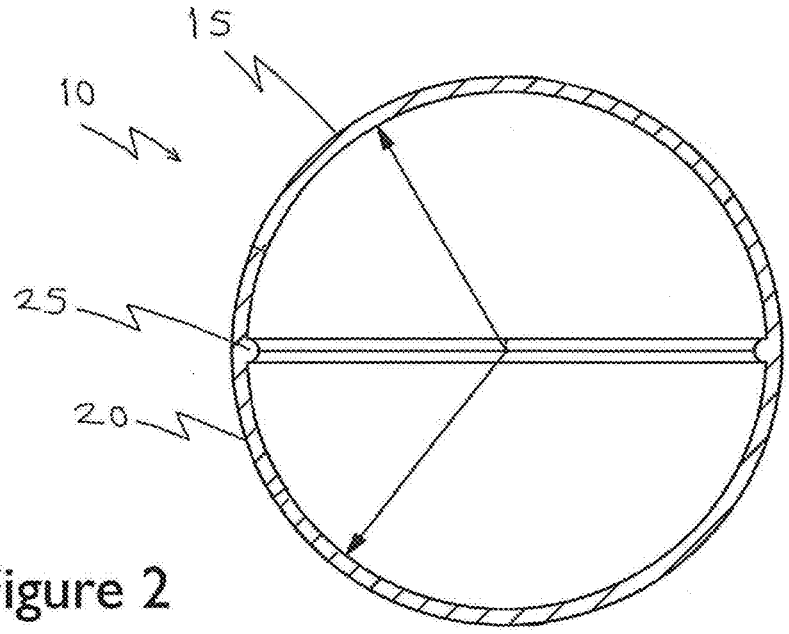
FIG. 2 is a section taken along line A-A of FIG. 1.
Figure 3A:
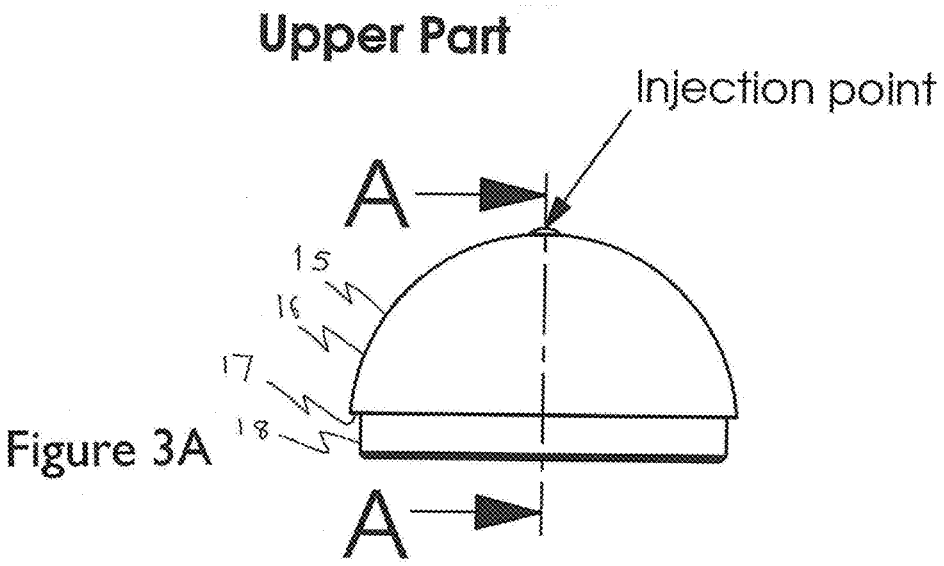
FIG. 3A is a side view of a first ball half forming part of the ball of FIG. 1.
Figure 3B:
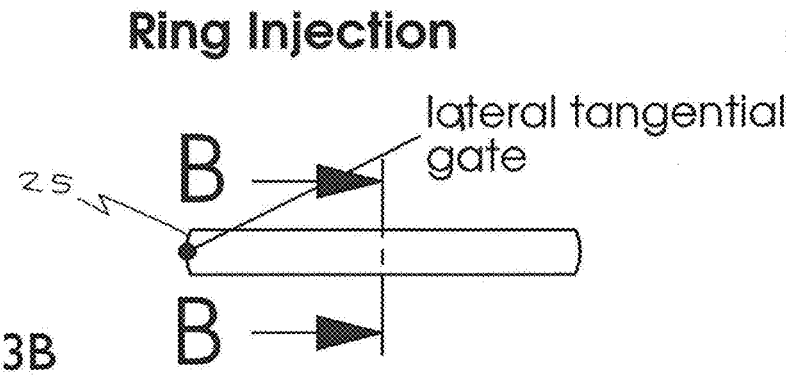
FIG. 3B is a side view of a connecting ring forming part of the ball of FIG. 1.
Figure 3C:
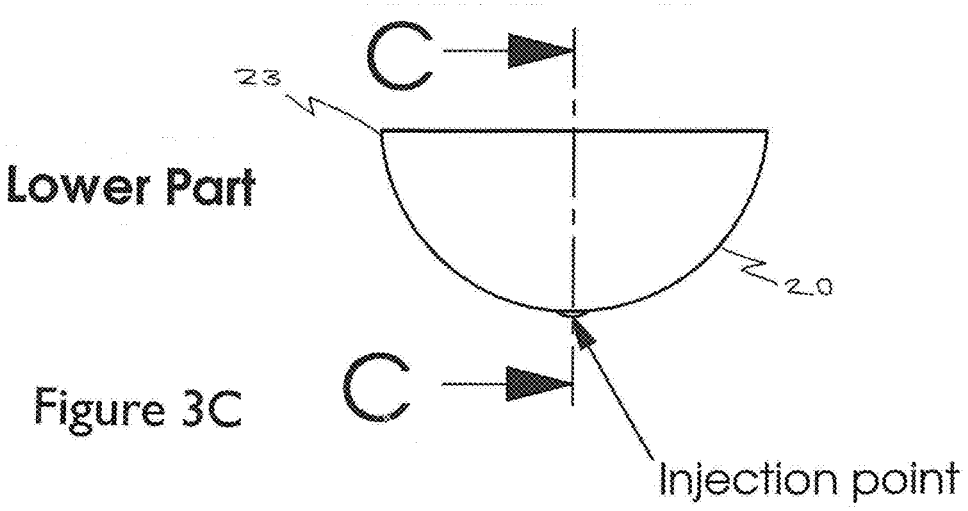
FIG. 3C is a side view of a second ball half forming part of the ball of FIG. 1.

Example embodiments are described below in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

The terminology used herein to describe embodiments is not intended to limit the scope. The articles "a," "an," and "the" are singular in that they have a single referent, however the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

Referring first to FIG. 1 there is shown a ball generally indicated 10. The ball may be referred to as a deodorant ball. In this sense the term "deodorant ball" is intended to mean a ball which may form part of a "roll-on" dispenser i.e. a dispenser of a liquid cosmetic (such as a deodorant) having a revolving ball as an applicator.

In FIGS. 2 to 6 the ball 10 is shown to comprise an "upper" generally hemispherical first ball half part 15, a "lower" generally hemispherical ball half part 20 and an equatorial, central generally annular connecting ring 25.

The ball half 15 comprises a hemispherical shell part 16. At the periphery of the part a radially inward step 17 (inclined slightly away from the centre line) is provided from which emerges an inner flange 18.

The ball half 20 is correspondingly shaped and comprises a hemispherical shell part 21, a radially inward step 22 (inclined slightly away from the centre line) being formed at the periphery (which receives the flange 18—see below) and an outer flange 23.

The ring 25 is generally annular. It will be noted from FIG. 6 that when the ball half parts 15, 20 are brought together the flange 18 engages with the step 22 and an equatorial slot is formed in which the ring 25 sits. Accordingly the ring 25 is generally mushroom shape in section, with a dome 27 formed at the narrower end of a trapezium 26. The dome 27 of the ring section lies external to the ball, as shown best in FIGS. 5 and 6.

Figure 5:
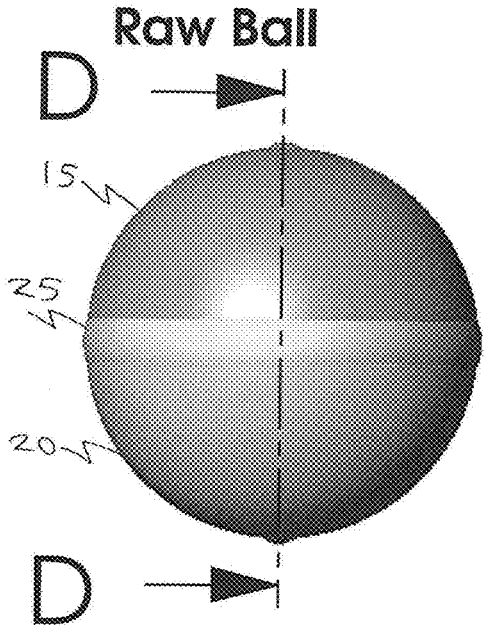
FIG. 5 is a side view of a ball formed accordance with the present invention and prior to post-forming processing.
Figure 6:
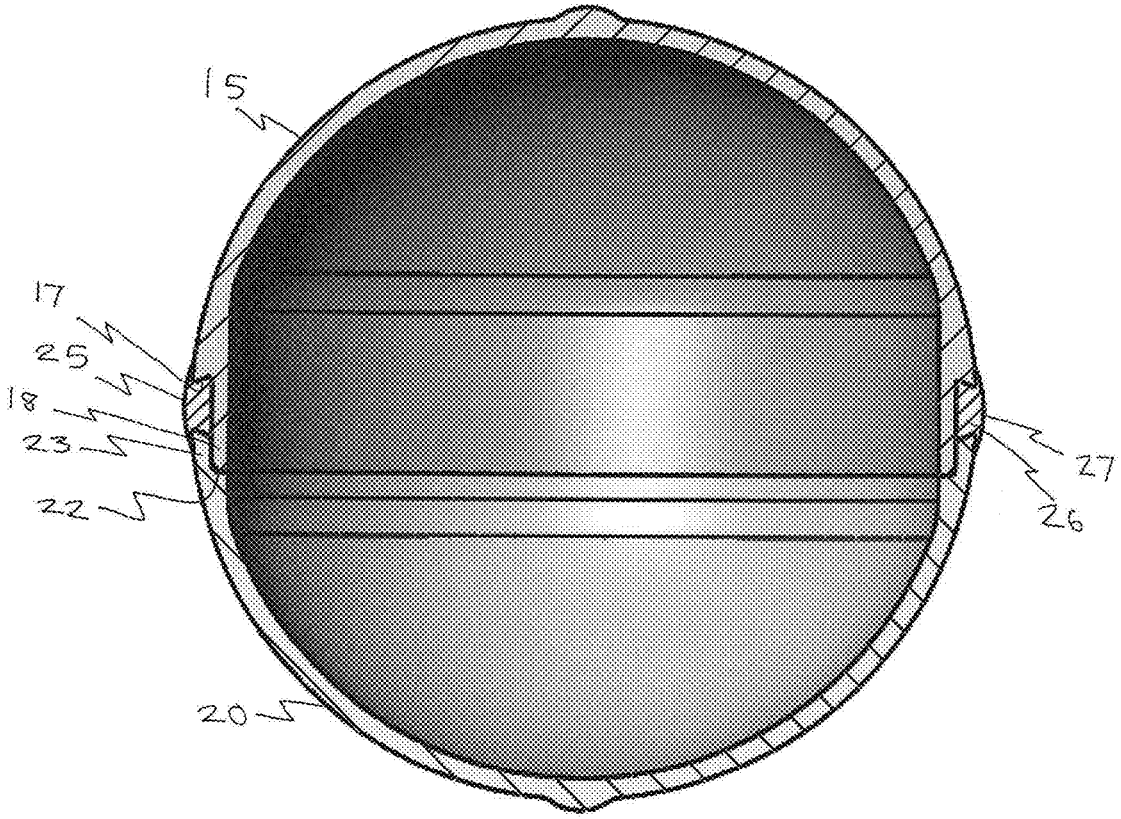
FIG. 6 is section taken along line D-D of FIG. 5.
Figure 7:
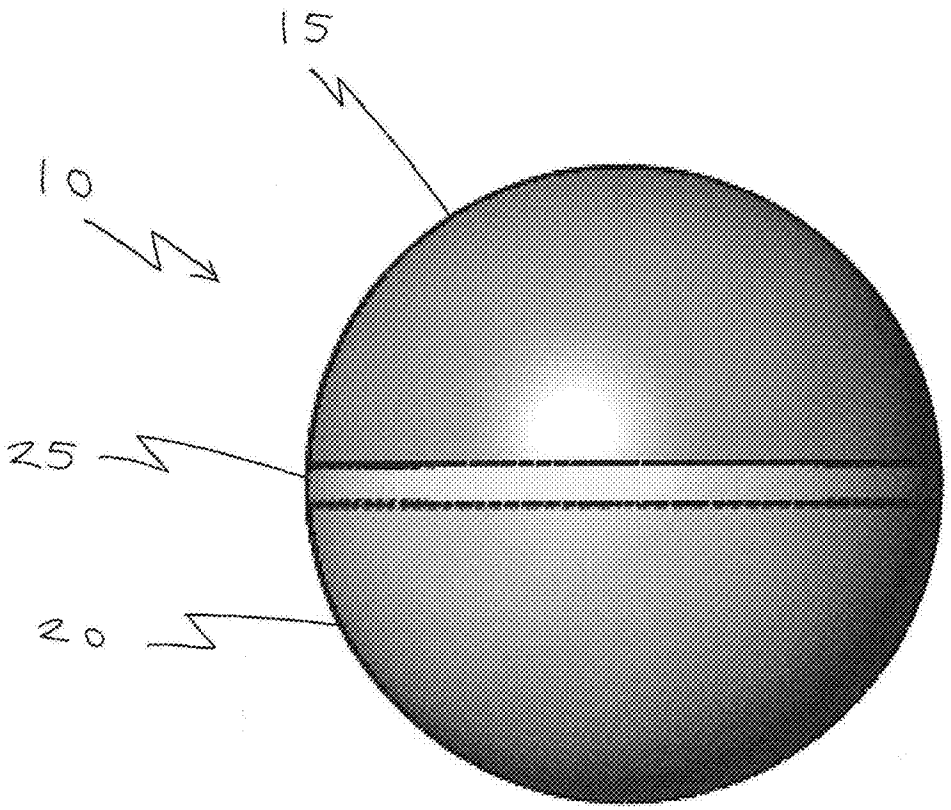
FIG. 7 is a side view of the ball of FIG. 5 following post-forming processing.
Figure 8:
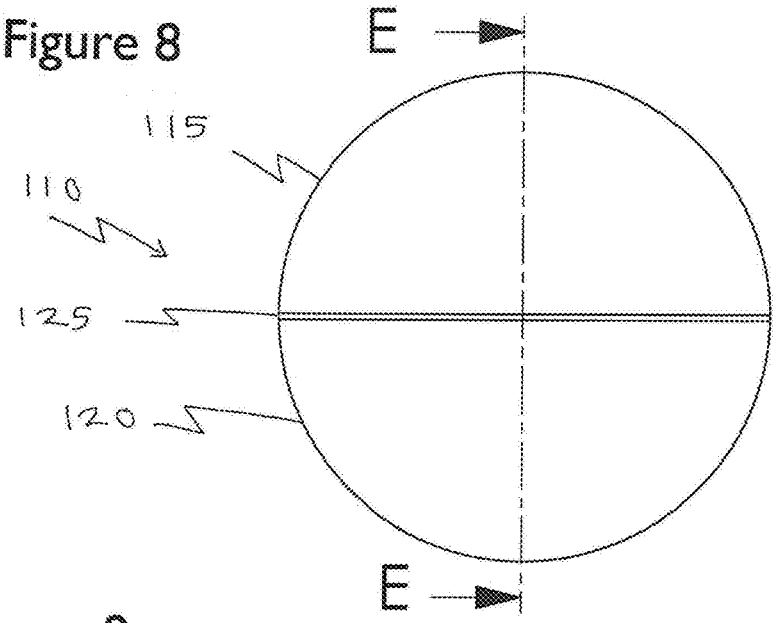
FIG. 8 is side view of a ball formed according to a further embodiment of the present invention.
Figure 9:
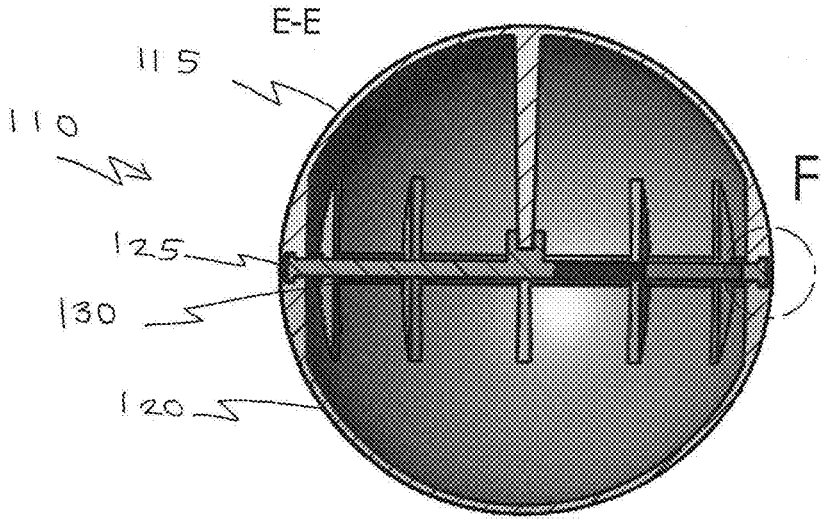
FIG. 9 is a section taken along line E-E of FIG. 8.
Figure 10:
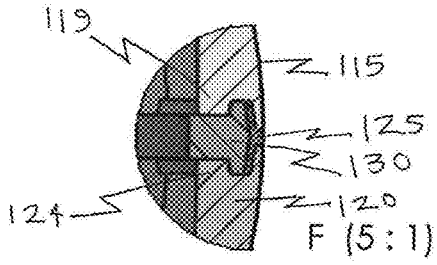
FIG. 10 is a magnified view of the part of the ball indicated F in FIG. 9.
Figure 11A:
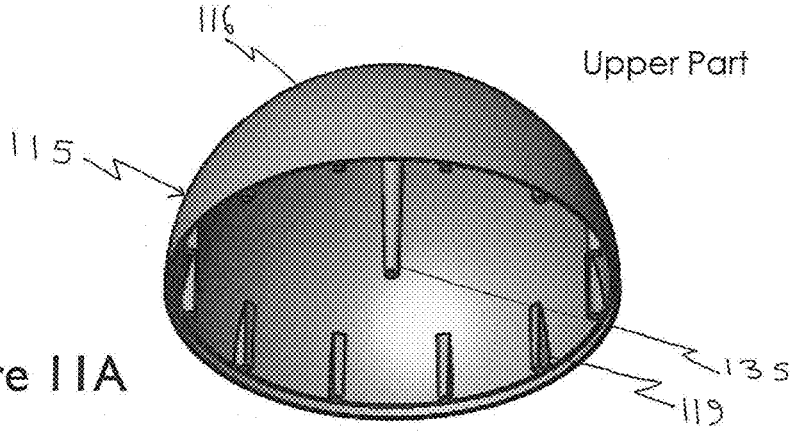
FIG. 11A is a perspective view of a ball upper part forming part of the ball of FIG. 8.
Figure 11B:
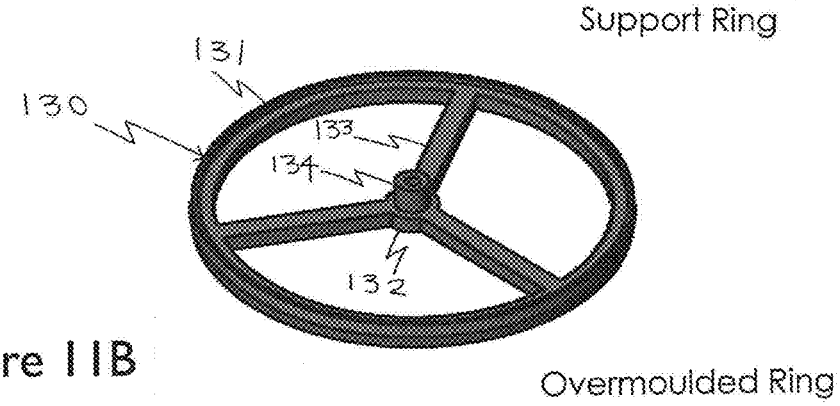
FIG. 11B is a perspective view of a support ring forming part of the ball of FIG. 8.
Figure 11D:
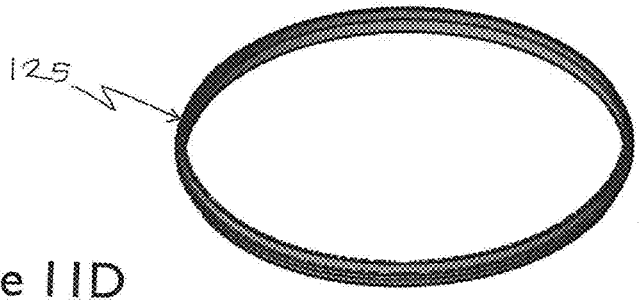
FIG. 11D is a perspective view of a ring forming part of the ball of FIG. 8.
Figure 11C:
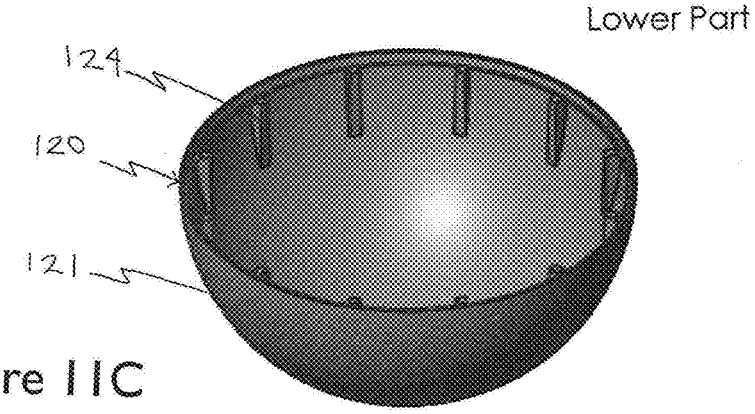
FIG. 11C is a perspective view of a ball lower part forming part of the ball of FIG. 8.
Figure 13A:
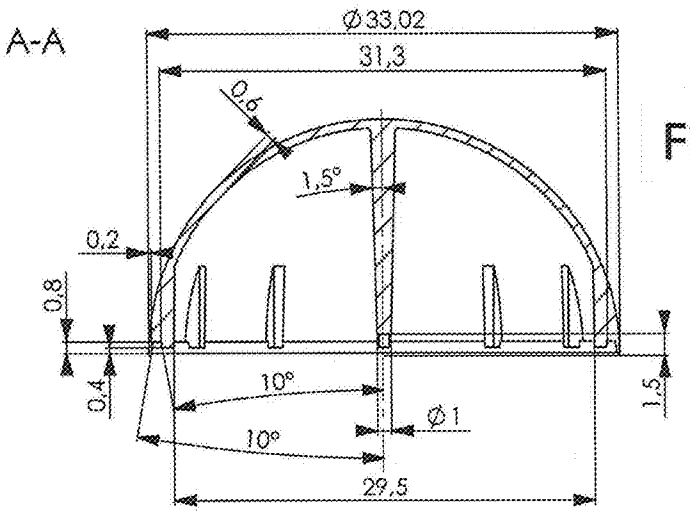
FIG. 13A is a section taken along line A-A of FIG. 12A.
Figure 13B:
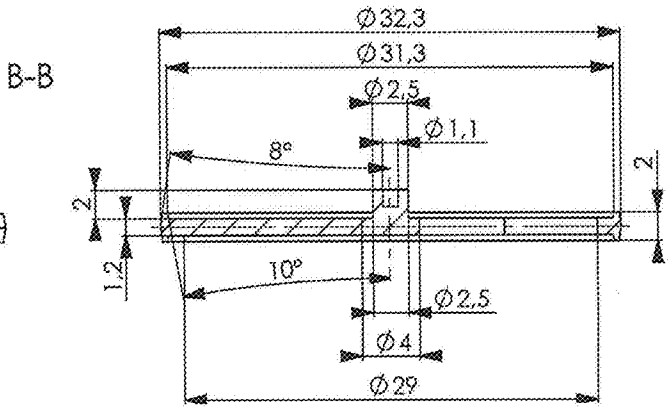
FIG. 13B is a section taken along line B-B of FIG. 12B.
Figure 12A:
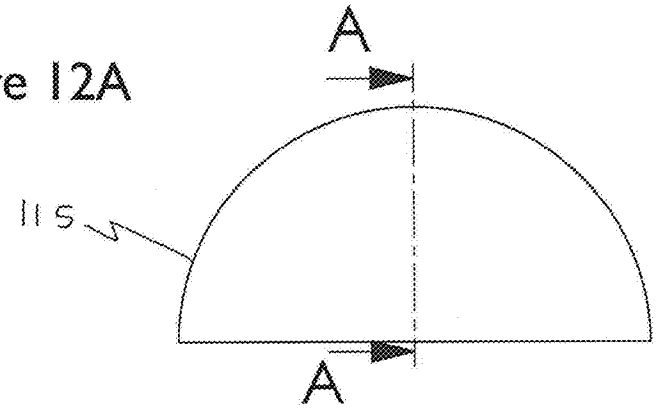
FIG. 12A is a side view of the ball part of FIG. 11A.
Figure 12B:
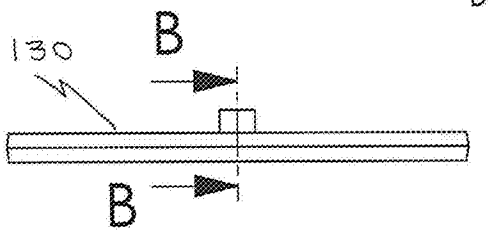
FIG. 12B is a side view of the ball part of FIG. 11B.
Figure 13C:
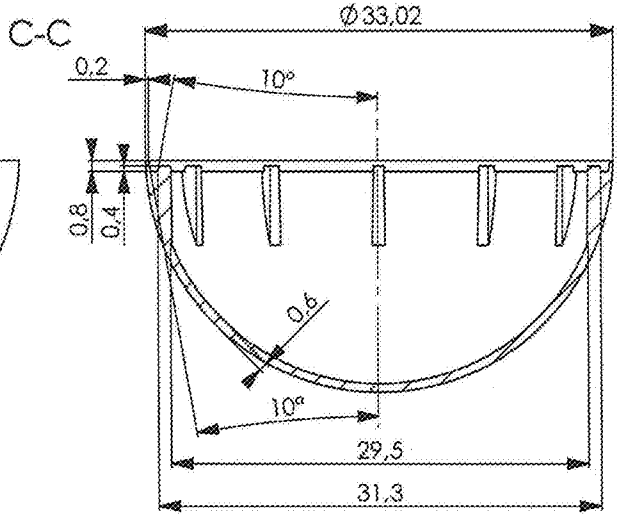
FIG. 13C is a section taken along line C-C of FIG. 12B.
Figure 12C:
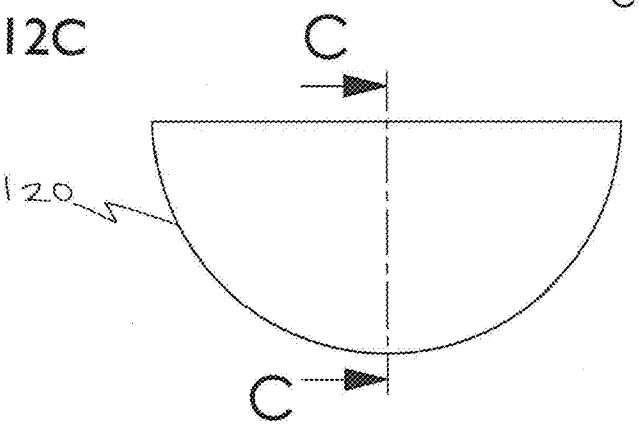
FIG. 12C is a side view of the ball part of FIG. 11C.
Figure 13D:
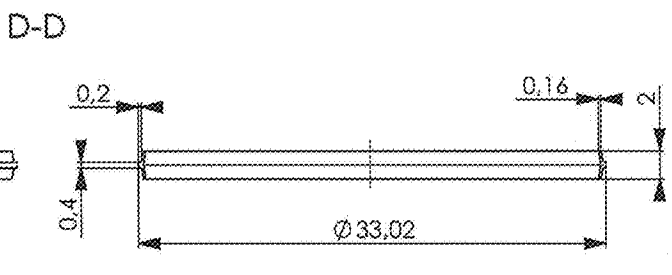
FIG. 13D is a section taken along line D-D of FIG. 12D.
Figure 12D:
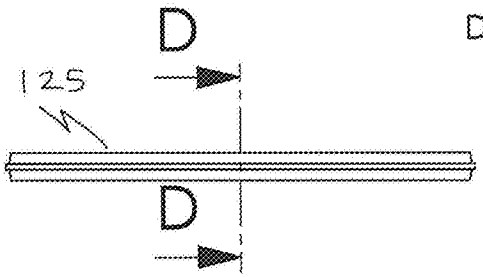
FIG. 12D is a side view of the ball part of FIG. 11D.

In FIG. 5 the ball 10 is shown in a raw state i.e. following formation. The ball may be processed further, for example by grinding to form a finished ball (FIG. 6) with a smooth exterior.

The ball may be formed by: injection molding the half parts 15, 20; assembling the parts 15, 20 together; and overmolding the ring 25 around the equator of the assembly ball parts to connect the parts together.

Figure 4A:
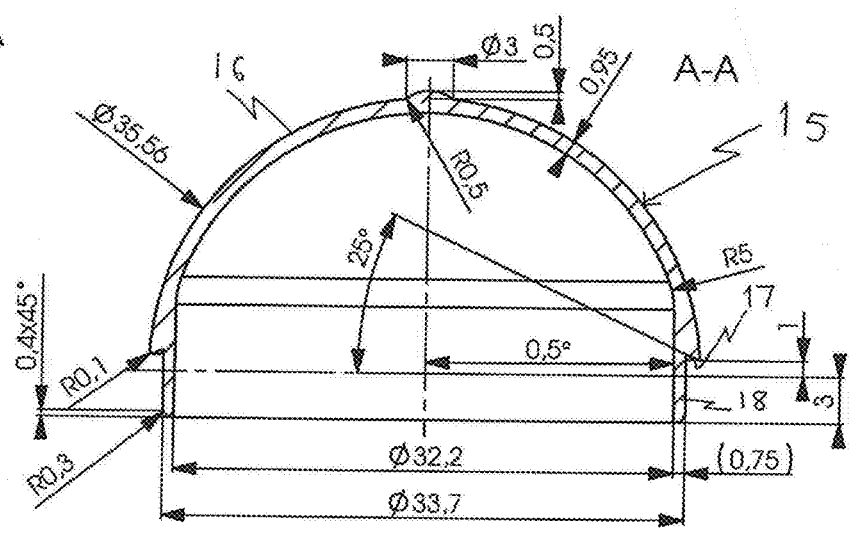
FIG. 4A is a section taken along line A-A of FIG. 3A.
Figure 4B:
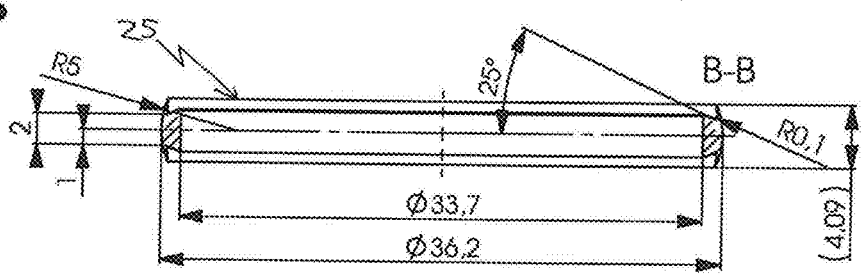
FIG. 4B is a section taken along line B-B of FIG. 3B.
Figure 4C:
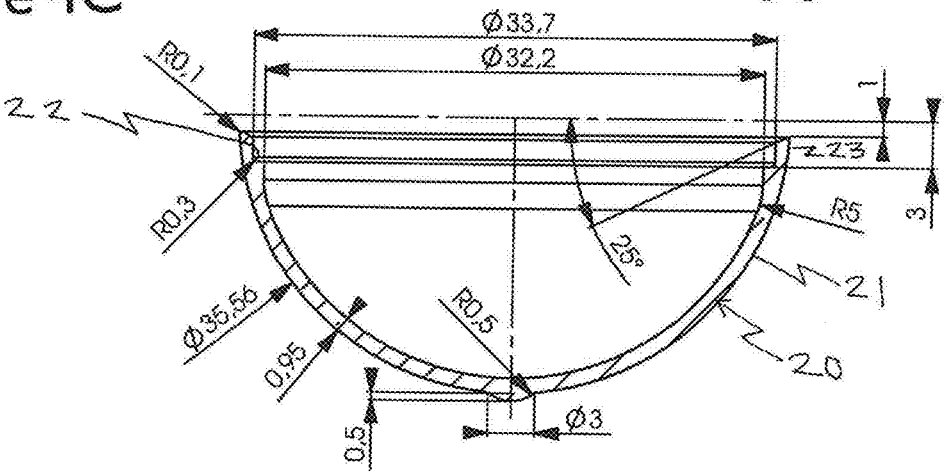
FIG. 4C is a section taken along line C-C of FIG. 3C.

FIG. 4 shows dimensions. In some embodiments balls may be formed in accordance with such dimensions. However, in other embodiments other dimensions may be used and this should not be considered as limiting.

Referring now to FIGS. 8 to 13 there is shown a ball 110 formed according to an alternative embodiment.

The ball 110 is similar to the ball 10 and comprises generally hemispherical ball parts 115, 120 and a connecting ring 125. In this embodiment a central, internal support ring is also provided.

The upper ball part 115 comprises a hemispherical shell part 116. The periphery of the part 116 is shaped to receive the connecting ring 125 and also the rim 131 of the support ring 130. The shell part 116 comprises a plurality of internal ribs 119 and a post 135 depending from the centre of the part and extending so as to engage with the hub 132 of the support ring (best shown in FIG. 9).

The lower ball part 120 comprises a hemispherical shell part 121. The periphery of the part 120 is shaped to receive the connecting ring 125 and also the rim 131 of the support ring 130. The shell part 120 comprises a plurality of internal ribs 124. In this embodiment the peripheral shapes of the parts 115, 120 is the same i.e. they are symmetrical.

The support ring 130 comprises a generally annular rim 131 and a central hub 132. A plurality, in this embodiment three, radial spokes 133 extend from the hub to the rim. The hub 132 comprises a central cylindrical socket 134 into which is received the shell post 135.

The ring 125 is generally annular with a generally truncated T-shape cross section.

The ball 110 is formed by moulding the ball parts 115, 120 and the support ring 130 and then assembling them together. The shell part ribs 119, 124 abut against opposite sides of the rim 131 and the post 135 engages in the socket 134. The connecting ring 125 is then overmoulded into the cavity formed between the shell part peripheries and the support ring rim 131.

FIG. 13 shows dimensions. In some embodiments balls may be formed in accordance with such dimensions. However, in other embodiments other dimensions may be used and this should not be considered as limiting.

The support ring may be formed by injection molding.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention.

The invention claimed is:

1. A roll-on applicator ball structure comprising:

a first ball part;

a second ball part; and a generally annular connecting ring to connect the first and second ball parts together;

the first ball part being a molded upper part, the second ball part being a molded lower part, and the generally annular connecting ring being an overmolded ring which connects the first and second ball parts after they are assembled.

2. The ball structure as claimed in claim 1, in which the first and second ball parts are formed by injection molding.

3. The ball structure as claimed in claim 1, in which the connecting ring is formed by injection molding.

4. The ball structure as claimed in claim 1, further comprising a support ring.

5. The ball structure as claimed in claim 4, in which the support ring comprises a peripheral annulus, a hub, and one or more spokes extending from the hub to the annulus.

6. The ball structure as claimed in claim 5, in which the first ball part includes a depending post which engages the hub.

7. The ball structure as claimed in claim 1, in which the first and second ball parts are different, similar, or substantially the same.

8. The ball structure as claimed in claim 1, in which the first and second ball parts are formed from polypropylene.

9. The ball structure as claimed in claim 1, in which the first ball part is generally hemispherical, the second ball part is generally hemispherical, and the connecting ring is equatorial.

10. The ball structure as claimed in claim 1, in which the first and second ball parts include internal ribs.

11. The ball structure as claimed in claim 1, in which the first ball part is generally hemispherical, at a periphery of the first ball part a first radially inward step is provided, an inner flange emerges from the first radially inward step, in which the second ball part is generally hemispherical, at a periphery of the second ball part a second radially inward step is provided, an outer flange emerges from the second radially inward step, and in which, when the first and second ball parts are brought together, the inner flange engages the second radially inward step and an equatorial slot is formed, and the connecting ring sits in a slot.

12. The ball structure as claimed in claim 1, having a diameter in a range of 1 inch to 1.4 inches.

13. The ball structure as claimed in claim 1, in which the connecting ring is generally mushroom-shaped in section.

14. A roll-on dispenser including a ball structure, the ball structure comprising a first ball part, a second ball part, and a generally annular connecting ring to connect the first and second ball parts together;

the first ball part being a molded upper part, the second ball part being a molded lower part, and the generally annular connecting ring being an overmolded ring which connects the first and second ball parts after they are assembled.

15. A method of forming a roll-on applicator ball comprising steps of:

a. forming a first ball part and a second ball part;

b. assembling the first and second ball parts; and c. forming an annular connecting ring on the assembled first and second ball parts to join them together;

the first ball part being a molded upper part, the second ball part being a molded lower part, and the annular connecting ring being an overmolded ring which connects the first and second ball parts after they are assembled.

16. The method as claimed in claim 15, further comprising the steps of forming a support ring and assembling the support ring together with the first and second ball parts at step b).

17. The method as claimed in claim 16, in which at least one of the first ball part, the connecting ring, and the support ring are formed by injection molding.

18. The method as claimed in claim 15, in which formation of the first and second ball parts, and optionally a support ring, their assembly, and the addition of the connecting ring take place in one machine.

19. The method as claimed in claim 15, further comprising the step of grinding at least part of a surface of the ball.

20. A roll-on applicator ball structure comprising:

a first ball part;

a second ball part; and a generally annular connecting ring to connect the first and second ball parts together;

in which the first ball part is generally hemispherical, at a periphery of the first ball part a first radially inward step is provided, an inner flange emerges from the first radially inward step, in which the second ball part is generally hemispherical, at a periphery of the second ball part a second radially inward step is provided, an outer flange emerges from the second radially inward step, and in which, when with the first and second ball parts are brought together, the inner flange engages the second radially inward step and an equatorial slot is formed, and the connecting ring sits in a slot.

* * * * *